US012714172B2

(12) United States Patent
Riederer et al.

(10) Patent No.: US 12,714,172 B2
(45) Date of Patent: Aug. 25, 2026

(54) PROTECTIVE HELMET

(71) Applicant: ABUS August Bremicker Söhne KG, Wetter-Volmarstein (DE)

(72) Inventors: Frank Riederer, Dortmund (DE); Marc Von Dunten, Essen (DE); Niklas Baumeister, Wuppertal (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 11 days.

(21) Appl. No.: 18/609,017

(22) Filed: Mar. 19, 2024

(65) Prior Publication Data

US 2024/0334996 A1 Oct. 10, 2024

(30) Foreign Application Priority Data

Apr. 6, 2023 (DE) ..... 102023108839.4

(51) Int. Cl.
*A42B 3/06* (2006.01)
*A42B 3/28* (2006.01)

(52) U.S. Cl.
CPC ..... *A42B 3/063* (2013.01); *A42B 3/28* (2013.01)

(58) Field of Classification Search
CPC ..... A42C 2/002; A42C 2/00; A42B 3/066; A42B 3/28; A42B 3/062
See application file for complete search history.

(56) References Cited

U.S. PATENT DOCUMENTS

| | | | | |
|---|---|---|---|---|
| 7,069,601 | B1 | 7/2006 | Jacobsen | |
| 2016/0018361 | A1 | 1/2016 | Trimpin et al. | |
| 2016/0183619 | A1 | 6/2016 | Del Ramo | |
| 2019/0183203 | A1* | 6/2019 | Krynock | A42B 3/28 |

FOREIGN PATENT DOCUMENTS

| | | | | |
|---|---|---|---|---|
| DE | 29906225 | U1 | 8/1999 | |
| EP | 1856997 | A2 | 11/2007 | |
| EP | 2837300 | B1 | 5/2016 | |
| WO | WO-0035307 | A1 * | 6/2000 | A42C 2/00 |
| WO | WO-2022187656 | A1 * | 9/2022 | A42B 3/066 |
| WO | WO-2022243803 | A1 * | 11/2022 | A42C 2/002 |

* cited by examiner

*Primary Examiner* — Grady Alexander Nunnery
(74) *Attorney, Agent, or Firm* — Dickinson Wright PLLC

(57) ABSTRACT

A helmet comprises a shock-absorbing helmet body, which has at least one ventilation opening, and a connection structure that is embedded in the helmet body. A bridge section of the connection structure passes through the at least one ventilation opening and has a connection web and a fiber arrangement that is formed separately from the connection web and that extends along the connection web.

14 Claims, 3 Drawing Sheets

PROTECTIVE HELMET

CROSS-REFERENCE TO RELATED APPLICATION

This application claims the benefit and priority of German Patent Application No. DE 102023108839.4 filed on Apr. 6, 2023. The entire disclosure of the above application is incorporated herein by reference.

FIELD

The invention relates to a helmet, in particular a bicycle helmet or another protective helmet, comprising a shock-absorbing helmet body, which has at least one ventilation opening, and a connection structure that is embedded in the helmet body, wherein a bridge section of the connection structure passes through the at least one ventilation opening.

BACKGROUND OF THE INVENTION

Such a helmet serves to protect the user from head injuries in the case of a fall or of an impact of an object on the head of the user. Depending on the application, the protective helmet may serve and be designed as a sports helmet or a work protective helmet, for example as a bicycle helmet or a riding helmet. The helmet comprises a helmet body that, in terms of shape, thickness and material, is adapted to absorb the kinetic energy acting on the helmet on an impact (crash or impact) as much as possible by inelastic and/or elastic deformation. The helmet body may, for example, be formed from a hard foam. In particular when used as a bicycle helmet, the helmet body may have one or more ventilation openings to support a passive cooling of the head of the user by environmental air or headwind. The ventilation openings have to be designed to largely prevent an object of a certain size from entering despite the ventilation function.

The helmet may, at an outer side of the helmet body, have an outer shell that covers at least a part of the outer side of the helmet body, wherein the ventilation openings extend through the helmet body and the outer shell (in particular in a substantially radial direction). The helmet may have a connection structure that is embedded in the helmet body and webs that extend through the material of the helmet body (in particular in a substantially tangential direction). Such a connection structure serves to stabilize the helmet body or may even form a supporting structure of the helmet to which individual sections of the helmet body are fastened. The connection structure may form bridge sections that pass through the ventilation openings in an exposed manner, i.e. without being surrounded by the material of the helmet body.

To manufacture such a helmet in accordance with the so-called in-mold technology, the outer shell and the connection structure are placed into a mold. A casting material is then poured into the mold to form the helmet body, with the casting material connecting to the inner side of the outer shell and at least partly surrounding the connection structure. A permanently force-transmitting connection may be established between the helmet body, on the one hand, and the connection structure and the outer shell, on the other hand, with a few worksteps by this method. In this respect, a foaming of the casting material may be provided depending on the choice of the casting material. The method may in particular also be performed as an injection molding process in which the injection molding material is poured or injected into the mold under pressure.

The connection structure embedded in the helmet body may be formed from a plastic. Such a connection structure composed of plastic has proven to be expedient in practice. However, there may be a problem at very low temperatures when the material of the connection structure becomes brittle and thereby breaks more easily. This problem in particular affects the bridge sections of the connection structure that pass through the ventilation openings in an exposed manner.

SUMMARY OF THE INVENTION

It is the object of the invention to provide a helmet that enables an improved ventilation yet is sufficiently stable and safe with respect to an impact or an entry of an object.

This object is satisfied by a helmet having the features of claim 1.

The helmet according to the invention comprises a shock-absorbing helmet body, which has at least one ventilation opening, and a connection structure that is embedded in the helmet body, wherein a bridge section of the connection structure passes through the at least one ventilation opening, and wherein the bridge section of the connection structure has a connection web and a fiber arrangement that is formed separately from the connection web and that extends along the connection web.

The helmet thus has a shock-absorbing helmet body comprising an integrated connection structure and one or more ventilation openings. The helmet body can, for example, form a shell and have a generally concavely shaped inner side facing the head of the user and a generally convexly shaped outer side facing away from the head of the user. The respective ventilation opening may be peripherally closed. In some embodiments, it is also possible for the helmet body to have a plurality of helmet body sections that are separate from one another and that are connected to one another only via the connection structure so that the respective ventilation opening may be open not only in the radial direction but also laterally (e.g. towards a front side of the helmet and/or towards a rear side of the helmet).

The connection structure is at least partly embedded in the shock-absorbing helmet body, i.e. surrounded by the material of the helmet body. However, sections of the connection structure may also project from the helmet body, for example free ends or anchor points to which other parts of the helmet are fastened. The connection structure comprises one or more bridge sections that pass through a respective ventilation opening. Thus, at the respective ventilation opening, the connection structure projects from the helmet body and forms an exposed bridge section that may connect two helmet body sections adjoining the ventilation opening to one another. The respective bridge section of the connection structure comprises a connection web and a fiber arrangement that is formed separately from the connection web, i.e. as a materially separate element, and that extends along the connection web.

The connection web of the bridge section—just like the sections of the connection structure embedded in the helmet body—serves to stabilize the helmet body, for example, to prevent a breaking of the helmet body in the event of a fall or in the event of a relatively large object impacting the head of the user. The connection web of the bridge section may in particular absorb tensile forces along its direction of extent, i.e. across the respective ventilation opening. The connection web of the exposed bridge section may extend into the helmet body as a continuous web of the connection structure. The connection web may have an elongate shape. The connection web may generally be dimensionally stable in some embodiments.

The fiber arrangement of the bridge section supplements the stabilizing function of the connection web and in particular serves to protect against relatively small objects entering through the respective ventilation opening. The fiber arrangement of the bridge section may in particular absorb such forces that are exerted by an object towards the inner side of the helmet. Furthermore, the fiber arrangement of the bridge section may compensate for a temperature dependence of the stability of the associated connection web, in particular in that the fiber arrangement has a higher stability (e.g. tensile strength) at low temperatures than the connection web of the respective bridge section. If, for example, an object impacts the helmet and damages or—favored by low temperatures—even threatens to break through the connection web of the bridge section within a ventilation opening of the helmet body, the object may be intercepted by the fiber arrangement and may be prevented from further entry towards the inner side of the helmet.

For this purpose, the fiber arrangement extends along the connection web, but is formed separately from the connection web. The fiber arrangement of the respective bridge section may extend into the helmet body. However, this is not absolutely necessary; in some embodiments, the fiber arrangement may also only be provided along the exposed bridge section. The fiber arrangement may be significantly more flexible compared to the connection web of the respective bridge section. The fiber arrangement may be fixedly connected to the connection web of the respective bridge section (e.g. by an adhesive connection, as will be explained below); alternatively thereto, the fiber arrangement may at least sectionally extend loosely along the connection web, in particular directly adjacent to the connection web and/or contacting the connection web. The fiber arrangement may have an elongate shape. The fiber arrangement may extend along the underside of the connection web in some embodiments. The fiber arrangement of the respective bridge section may have a plurality of fibers, wherein, in some embodiments, the fibers may extend in different directions to one another, may overlap one another and/or may be connected to one another. In some embodiments, the fibers of the fiber arrangement may be embedded in a carrier material of the fiber arrangement.

Since the bridge section that passes through the respective ventilation opening not only has a connection web but also an additional fiber arrangement, the stability and the protective function are improved. The fiber arrangement effects a reinforcement of the respective connection web and it is possible to provide longer bridge sections and thus larger ventilation openings, which is advantageous for the ventilation function in particular in the case of racing bike helmets. Since the fiber arrangement is formed separately from the connection web of the respective bridge section, the manufacture of the connection structure is simplified. For the manufacture of the helmet, the connection structure may be easily prefabricated. For the casting of the helmet body, the prefabricated connection structure may thus be inserted into the mold without additional processing being necessary at this point in time and without the mold cooling down undesirably in the meantime. Furthermore, when the helmet is disposed of, a separation of the materials of the connection structure by raw material is possible in a simplified manner or at all since the fiber arrangement may be separated from the connection web more easily than in an integral design of these two components.

Location and direction indications used in connection with the invention generally refer to the intended arrangement of the helmet on the head of a user (e.g. "front side", "longitudinal direction") or to the shape of the helmet body curved as a spherical shell (e.g. "radial", "tangential").

Further possible embodiments are explained below.

In some embodiments, the connection structure may have a plurality of connection webs that are connected to one another and/or that extend in different directions. For example, at least one of the plurality of connection webs may substantially extend in a longitudinal direction and at least another one of the plurality of connection webs may substantially extend in a transverse direction of the helmet. Thus, in some embodiments, the connection structure may be formed in a cage-like manner, for example, as a curved grid. The connection structure may generally extend substantially along the entire helmet body or only along a part of the helmet body.

In some embodiments, the connection web may be dimensionally stable, i.e. the connection web may indeed be flexible to a certain extent (in particular elastic); however, in such embodiments, the connection web assumes a predetermined shape in the force-free state that may correspond to a curvature of the helmet body, for example. The connection structure consisting of a plurality of connection webs may in particular be dimensionally stable.

In some embodiments, the connection web may be formed from a plastic, for example from polyamide. In some embodiments, the connection web may, for example, be formed from a silicone. The connection web may in particular be formed from a single homogeneous material; a simple and inexpensive manufacture is thus possible, e.g. by casting, including injection molding. In some embodiments, the connection structure consisting of a plurality of connection webs, including the nodes at which the plurality of connection webs are connected to one another, may be formed by an originally single bonded part (as opposed to a plurality of parts subsequently joined together). A particularly simple and inexpensive manufacture is hereby also possible.

In some embodiments, the fiber arrangement may extend along an underside of the connection web facing the head of the user. The connection web may hereby be particularly effectively supported by the fiber arrangement within the respective ventilation opening. The connection web may in particular completely cover the fiber arrangement.

In some embodiments, within the ventilation opening, the connection web and the fiber arrangement may have a flat cross-section and extend in parallel with one another. In some embodiments, the fiber arrangement may have the same width as or a smaller width than the connection web.

In some embodiments, the connection web and the fiber arrangement may form a layer structure within the respective ventilation opening, for example a laminate, wherein even further layers may also be provided in addition to the connection web and the fiber arrangement (e.g. an adhesive layer and/or a carrier layer).

In some embodiments, the fiber arrangement of the bridge section may have a plurality of fibers. The fiber arrangement may in particular comprise plastic fibers and/or natural fibers. In some embodiments, metal fibers are also possible. Particularly high tensile strengths may, for example, be achieved if the fiber arrangement comprises carbon fibers, aramid fibers, or glass fibers.

The fibers of the fiber arrangement may extend in different directions to one another. For example, the fibers within the fiber arrangement may extend along a longitudinal direction of the bridge section of the connection structure, or transversely to the longitudinal direction of the bridge section, or in accordance with a combination thereof. The fibers may in particular overlap one another and/or be connected to one another, in an ordered or unordered manner, for example as a fabric, meshwork, knitted fabric or fleece. The individual fibers of the fiber arrangement may have the same length or different lengths. The length of the individual fibers may be less or greater than the width of the respective bridge section.

The individual fibers of the fiber arrangement may, in some embodiments, extend continuously along the entire length of the respective bridge section (as a strand of long fibers), in particular intertwined with one another or substantially in parallel with one another.

In some embodiments, the fiber arrangement of the bridge section may have a carrier layer, for example composed of a flexible plastic, on which the plurality of fibers rest or in which the plurality of fibers are embedded.

In some embodiments, the fiber arrangement may be formed as a flexible strip. The fiber arrangement may hereby be easily adapted to a curved shape of the associated connection web. Furthermore, a flexible strip shape may bring about a supplementary protective effect with regard to the explained breaking or breaking through of the associated connection web.

In some embodiments, the fiber arrangement may be fastened to the connection web via an adhesive connection. The fiber arrangement may be fastened to the connection web within the respective ventilation opening via the adhesive connection, in particular areally and/or along the entire length of the connection web and/or along the entire width of the connection web. The fastening of the fiber arrangement may in particular be provided at an underside of the connection web. The adhesive connection may comprise an adhesive layer separate from the fiber arrangement, or an adhesive for the adhesive connection with the connection web may be part of the fiber arrangement and may also fix the individual fibers of the fiber arrangement relative to one another.

In some embodiments, the fiber arrangement may be formed by a textile-reinforced adhesive tape. Such a textile-reinforced adhesive tape may comprise a plurality of fibers (as discussed above) and an adhesive layer. The adhesive layer may serve as a carrier material for the fibers in some embodiments. The adhesive layer may serve to establish an adhesive connection to fasten the fiber arrangement to the connection web. Such a textile-reinforced adhesive tape is also available as a commercially available product (e.g. glass fiber adhesive tape).

In some embodiments, the textile-reinforced adhesive tape may be areally connected to the connection web, in particular via said adhesive layer. For example, the textile-reinforced adhesive tape may be attached to the underside of the connection web. The textile-reinforced adhesive tape may be connected to the associated connection web at least along the respective bridge section (i.e. within the respective ventilation opening). In some embodiments, the textile-reinforced adhesive tape may also be connected to the associated connection web within the helmet body.

However, such a gluing or gluing behind of the connection web with the fiber arrangement is not absolutely necessary. In some embodiments, the fiber arrangement and the associated connection web may at least sectionally extend loosely next to one another, in particular contacting one another or at a spacing. In such embodiments, the fiber arrangement may be connected to the associated connection web only at some points, in particular at positions located within the helmet body and/or at a respective end of the associated connection web.

In some embodiments, the fiber arrangement is only fastened to the connection web within the helmet body. For example, the fiber arrangement may be folded around one end of the connection web and/or riveted, welded, or caulked to one end of the connection web.

In some embodiments, the bridge section of the connection structure may have a covering that covers the fiber arrangement towards the head of the user, i.e. towards the inner side of the helmet. Such a covering may in particular form a closed surface. The covering may extend along the respective bridge section, i.e. within the respective ventilation opening. In some embodiments, the covering may also extend into the helmet body. In particular when an adhesive is used (e.g. in the case of said textile-reinforced adhesive tape), such a covering may serve as protection against mechanical action and/or as protection of the adhesive against UV radiation and perspiration.

In some embodiments, the bridge section of the connection structure may have a peripherally substantially closed envelope of the fiber arrangement. "Substantially closed" in this context means that, for example, assembly gaps or ventilation openings may also be provided. For example, such an envelope may be liquid-tight towards the head of the user, i.e. towards the inner side of the helmet, but may have openings for venting an inner space of the envelope, in which the fiber arrangement is located, towards the outer side of the helmet. Such an envelope may also serve as protection against mechanical action and/or as protection against UV radiation and perspiration and may comprise said covering. The envelope may extend at least along the respective bridge section of the respective ventilation opening and optionally into the helmet body. In some embodiments, the envelope may be formed by the connection web or by a part of the connection web.

In some embodiments, the connection web may be configured as a duct or a channel in which the fiber arrangement extends, in particular in a fastened or loose manner. If the connection web is configured as a duct, the connection web may form said envelope of the fiber arrangement. If the connection web is configured as a channel, the connection web may laterally engage around the fiber arrangement. In such an embodiment, the bridge section of the connection structure may additionally have an elongate cover that closes the channel to form a peripherally substantially closed envelope. For example, such a cover may be clipped in at the channel or otherwise fastened in a force-fitting and/or form-fitting manner to the channel.

In such embodiments, the duct or the channel may also be configured to receive additional functional elements of the helmet, for example electrical cable connections or other electrical components.

In some embodiments, the helmet body may have a plurality of ventilation openings, wherein at least one respective bridge section of the connection structure passes through the respective ventilation opening. In some embodiments, at least some of the plurality of bridge sections, in particular their connection web and/or fiber arrangement, may have a different hardness.

In some embodiments, the helmet body may have a plurality of helmet body sections that are separate from one another and that are connected to one another via the connection structure. Thus, the connection structure may form a supporting structure of the helmet.

In some embodiments, the helmet body may be formed from a hard foam, in particular from an expanded polystyrene hard foam (EPS).

In some embodiments, the helmet may have an outer shell that covers at least a part of the outer side of the helmet body, wherein the outer shell may, for example, have a curved film, in particular composed of polyvinyl chloride (PVC), polyethylene terephthalate (PET) or a polycarbonate (PC). The outer shell may likewise fulfill a protective function (e.g. shock absorption or reduction of the coefficient of friction for a sliding along of the helmet at a rough surface) or it substantially only fulfills a decorative function.

In some embodiments, the helmet may have a lining at the inner side of the helmet body, such as a pad or a textile for sweat absorption. A strap fixing system may furthermore be fastened to the helmet body by means of which the helmet body may be fixed to the head of the user and which may, for example, comprise neck straps and chin straps.

The invention also relates to a method of manufacturing a helmet of the type explained in which a connection structure is formed by providing a connection web with a fiber arrangement; by placing the connection structure into a mold; and by pouring a casting material into the mold to form a helmet body having at least one ventilation opening such that a bridge section of the connection structure passes through the at least one ventilation opening in an exposed manner.

DRAWINGS

The invention will be described in the following only by way of example with reference to the drawings. Identical or similar elements are designated therein with the same reference numerals.

DETAILED DESCRIPTION OF THE INVENTION

Figure 1:
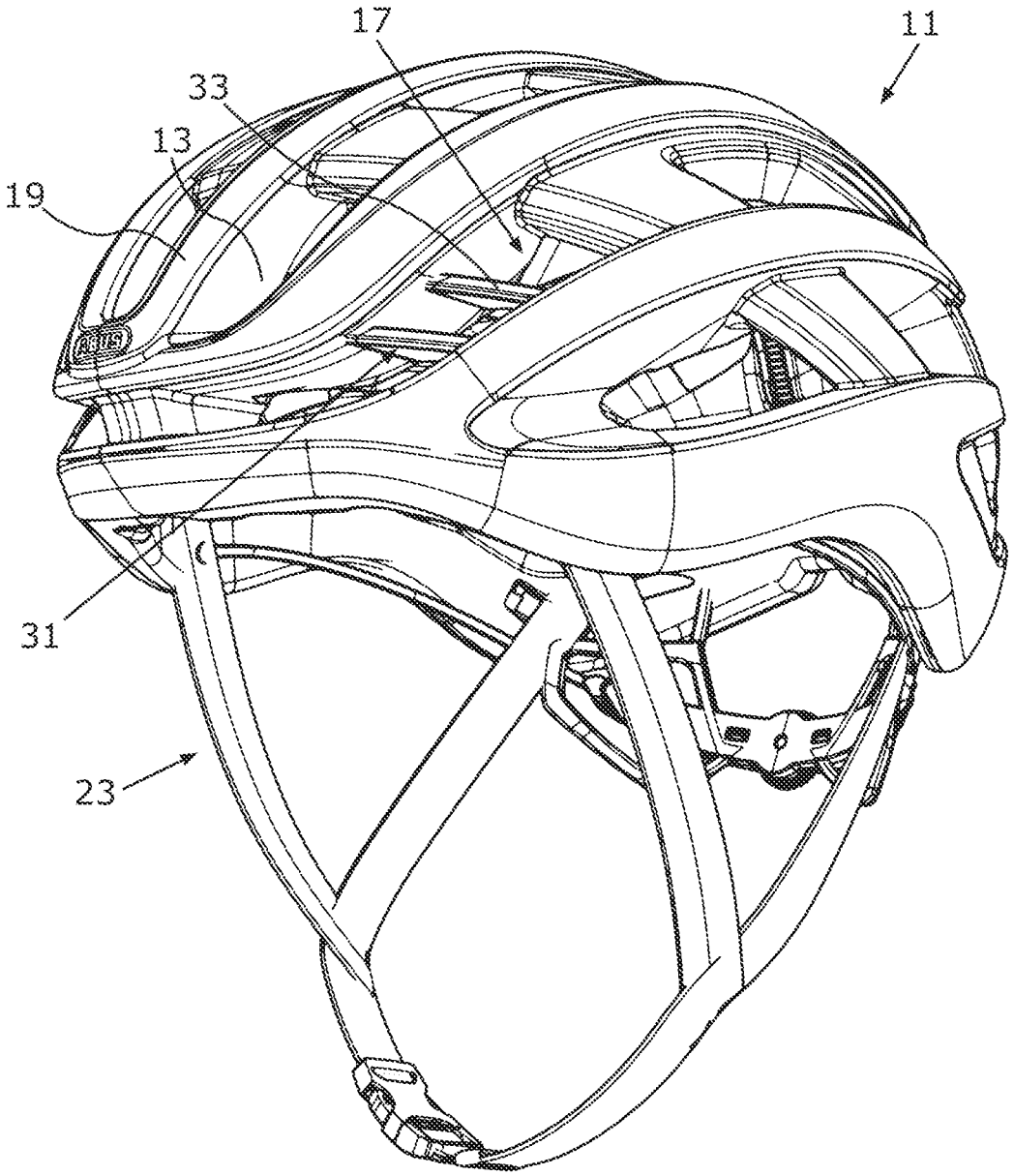
FIG. 1 shows a helmet.

FIG. 1 shows a helmet in the form of a bicycle helmet. The helmet 11 comprises a shock-absorbing helmet body 13 that is formed from a hard foam and that has a plurality of ventilation openings 17. The helmet body 13 is provided with an outer shell 19 at parts of the upper side of the helmet 11. The helmet 11 furthermore comprises a strap fixing system 23 fastened to the helmet body 13.

A connection structure 31 is embedded in the helmet body 13 that projects from the helmet body 13 in some of the ventilation openings 17 and that passes through the respective ventilation opening 17 as an exposed bridge section 33.

Figure 2:
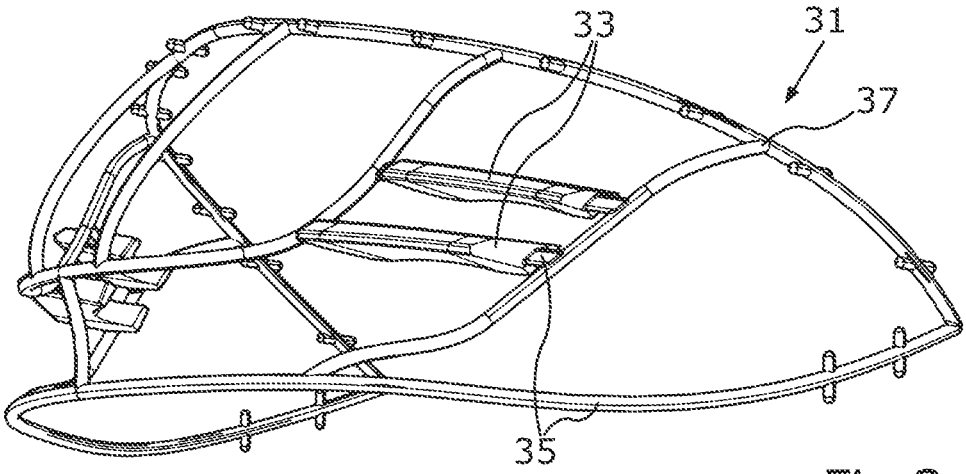
FIG. 2 shows a connection structure.

FIG. 2 shows the connection structure 31 without the helmet body 13. The connection structure 31 comprises a plurality of connection webs 35 connected to one another at nodes 37. The connection structure 31 is dimensionally stable, i.e. the connection structure 31 has a certain rigidity, and it forms an approximately spherically curved grid. The connection structure 31 may, for example, be formed by a single molded or injection-molded part composed of plastic, for example of polyamide.

Figure 3A:
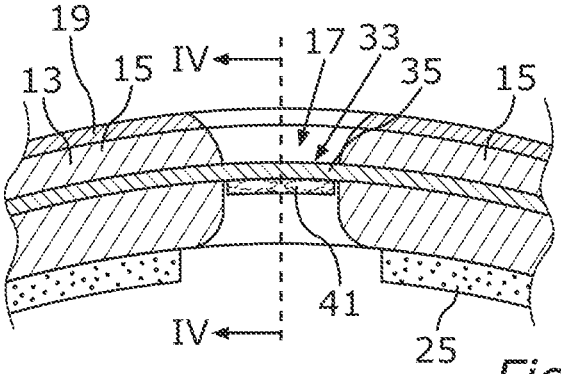
FIGS. 3A to 3C show longitudinal sections through a ventilation opening of a helmet.

FIG. 3A shows a part of a longitudinal section through a ventilation opening 17 of the helmet 11 that is passed through by a bridge section 33 of the connection structure 31. The helmet body 13, the outer shell 19 at the outer side of the helmet body 13, and a lining 25 (such as a pad) at the inner side of the helmet body 13 facing the head of the user are also shown.

The bridge section 33 comprises a part of an elongate connection web 35 that extends into the helmet body 13 and that is thus embedded in the helmet body 13 in the environment of the ventilation opening 17. The connection web 35 thus connects two helmet body sections 15 to one another.

The bridge section 33 further comprises a fiber arrangement 41 that is formed separately from the connection web 35 and that extends within the ventilation opening 17 along the underside of the connection web 35 in parallel with the connection web 35. The fiber arrangement 41 comprises a plurality of fibers. For example, the fiber arrangement 41 may comprise a plurality of fibers of different lengths that extend in different directions to one another, that overlap one another, and that are connected to one another. The fibers of the fiber arrangement 41 may be directly connected to one another (for example, by forming a fabric) or indirectly (for example, by the fibers being embedded in a flexible carrier layer). The fibers of the fiber arrangement 41 may, for example, comprise plastic fibers, natural fibers, and/or metal fibers.

In the embodiment shown in FIG. 3A, the fiber arrangement 41 only extends within the ventilation opening 17. The fiber arrangement 41 may, for example, be fastened to the connection web 35 via an adhesive connection, in particular along the entire length and width of the fiber arrangement 41. The fiber arrangement 41 may, for example, be a textile-reinforced adhesive tape.

It can also be seen from FIG. 3A that, when the helmet 11 is used, the bridge section 33 of the connection structure 31 is spaced apart from the head of the user since the connection web 35 extends between the outer side and the inner side of the helmet body 13.

Figure 3B:
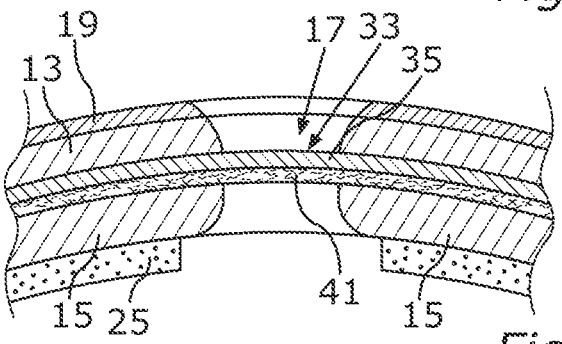

FIG. 3B shows an embodiment in which the fiber arrangement 41—in contrast to FIG. 3A—extends into the helmet body 13 together with the connection web 35 and is embedded in the helmet body 13.

Figure 3C:
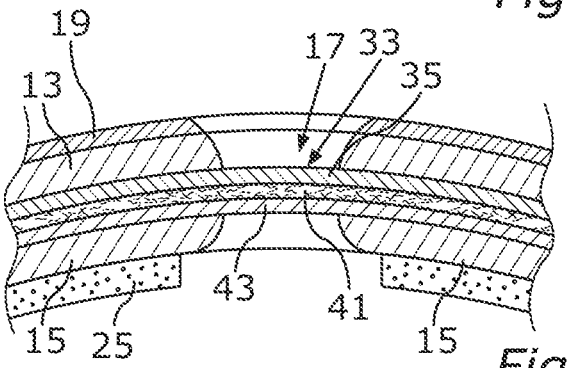

FIG. 3C shows an embodiment in which the bridge section 33 of the connection structure 31 additionally has a covering 43 that is positioned at the underside of the fiber arrangement 41 and that thus covers the fiber arrangement 41 towards the head of the user.

FIGS. 4A to 4D show possible embodiments of a bridge section 33 in a cross-section through a ventilation opening 17 of the helmet 11 along the plane IV-IV according to FIG. 3A.

Figure 4A:
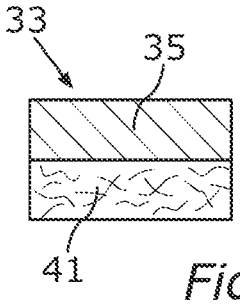
FIGS. 4A to 4D show cross-sections through a bridge section of a connection structure.

FIG. 4A shows an embodiment in which the fiber arrangement 41 (for example as a textile-reinforced adhesive tape) has a flat cross-section and is areally fastened to the connection web 35.

Figure 4B:
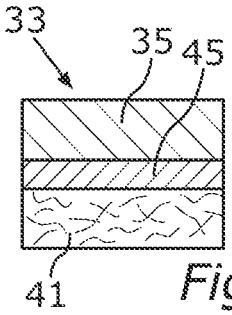

FIG. 4B shows an embodiment in which an adhesive layer 45 is additionally provided between the connection web 35 and the fiber arrangement 41. In such an embodiment, the fibers of the fiber arrangement 41 may, for example, be embedded in a carrier material separate from the adhesive layer 45.

Figure 4C:
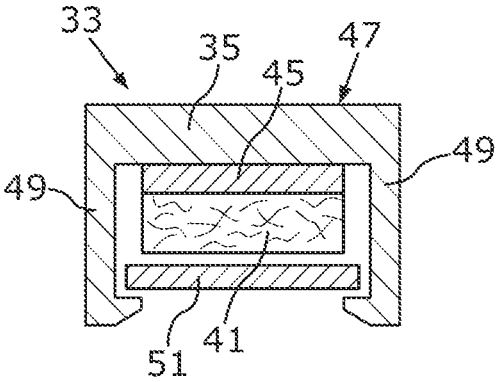

FIG. 4C shows an embodiment in which the connection web 35 is configured as a channel 47 having two side walls 49. The fiber arrangement 41 is fastened to the base of the channel 47. The bridge section 33 further comprises a cover 51 that closes the channel 47 and that may, for example, be clipped in at the channel 47. The channel 47 and the cover 51 hereby form a peripherally closed envelope 53.

Figure 4D:
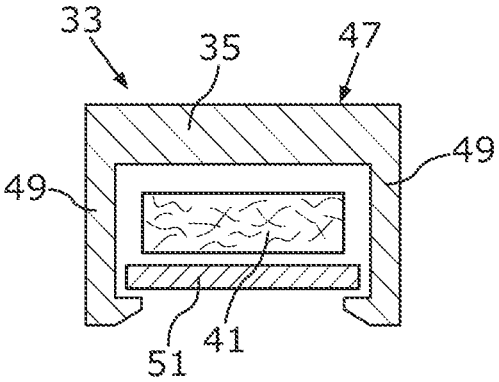

FIG. 4D shows an embodiment similar to FIG. 4C, wherein the fiber arrangement 41 is here held loosely within the envelope 53 and extends adjacent to the connection web 35.

Figure 5:
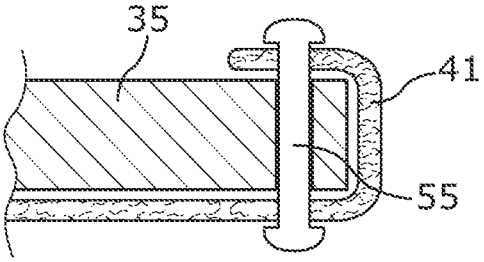
FIG. 5 shows a longitudinal section through one end of a connection web to which a fiber arrangement is fastened.

FIG. 5 shows a longitudinal section through one end of a connection web 35 to which a fiber arrangement 41 is fastened in that the fiber arrangement 41 is folded around the end of the connection web 35 and is fixed by means of a rivet 55. In such an embodiment, the fiber arrangement 41 does not have to be fastened along its entire length to the connection web 35 (for instance via the adhesive connection explained), but the fiber arrangement 41 may extend loosely along the connection web 35 (for instance, as in the embodiment according to FIG. 4D). The end of the connection web 35 with the rivet 55 shown in FIG. 5 may be completely embedded in the material of the helmet body 13 (not shown in FIG. 5).

Within the respective ventilation opening 17, the fiber arrangement 41 of the bridge section 33 may supplement the stabilizing function of the connection web 31 and provide additional protection against relatively small objects entering through the ventilation opening 17. Due to the additional stabilization, it is also possible to provide longer bridge sections 33 and thus larger ventilation openings 17, which is advantageous for the ventilation function in particular in the case of racing bike helmets. Since the fiber arrangement 41 is formed separately from the connection web 35 of the bridge section 33 (and is not, for instance, integrated into the material of the connection web 35), the manufacture of the connection structure 31 of the helmet 11 is simplified. Furthermore, when the helmet 11 is disposed of, a separation of the materials of the connection structure 31 by raw material is simplified.

The invention claimed is:

1. A helmet comprising:

a shock-absorbing helmet body, which has at least one ventilation opening, and a connection structure that is embedded in the helmet body, wherein a bridge section of the connection structure passes through the at least one ventilation opening, wherein the bridge section of the connection structure comprises a connection web and a fiber arrangement that is formed separately from the connection web and is fastened to the connection web via an adhesive connection;

wherein the fiber arrangement comprises a textile-reinforced adhesive tape that extends along the connection web and that is surface-connected to the connection web;

wherein the textile-reinforced adhesive tape is fastened to the connection web within the at least one ventilation opening via the adhesive connection along the entire length of the connection web, wherein the textile-reinforced adhesive tape extends into the helmet body together with the connection web and is embedded in the helmet body.

2. The helmet according to claim 1, wherein the connection structure comprises a plurality of connection webs that are connected to one another.

3. The helmet according to claim 1, wherein the connection web is dimensionally stable.

4. The helmet according to claim 1, wherein the fiber arrangement extends along an underside of the connection web and is configured to face a head of a user.

5. The helmet according to claim 1, wherein, within the ventilation opening, the connection web and the fiber arrangement have a flat cross-section and extend in parallel with one another.

6. The helmet according to claim 1, wherein the fiber arrangement of the bridge section comprises a plurality of fibers.

7. The helmet according to claim 6, wherein the textile-reinforced adhesive tape comprises the plurality of fibers and an adhesive layer that serves as a carrier material for the plurality of fibers.

8. The helmet according to claim 1, wherein the fiber arrangement is formed as a flexible strip.

9. The helmet according to claim 1, wherein the bridge section of the connection structure has a covering that covers the fiber arrangement and is configured to be towards a head of a user.

10. The helmet according to claim 1, wherein the bridge section of the connection structure comprises a peripherally substantially closed envelope of the fiber arrangement.

11. The helmet according to claim 10, wherein the envelope is formed by the connection web or by a part of the connection web.

12. The helmet according to claim 1, wherein the connection web is configured as a duct or a channel in which the fiber arrangement extends.

13. The helmet according to claim 1, wherein, within the ventilation opening, the connection web and the fiber arrangement have a flat cross-section and extend in parallel with one another, and wherein the fiber arrangement extends along an underside of the connection web and is configured to face a head of a user.

14. The helmet according to claim 1, wherein the textile-reinforced adhesive tape is connected to the connection web within the helmet body.

* * * * *